US011072962B2

(12) United States Patent
Herrmann et al.

(10) Patent No.: US 11,072,962 B2
(45) Date of Patent: Jul. 27, 2021

(54) VEHICLE DOOR ASSEMBLY HAVING A DOOR DRIVE

(71) Applicant: BROSE FAHRZEUGTEILE GMBH & CO. KG, BAMBERG, Bamberg (DE)

(72) Inventors: Christian Herrmann, Grossheirath (DE); Wolfgang Uebel, Weitramsdorf (DE)

(73) Assignees: BROSE FAHRZEUGTEILE GMBH & CO., Bamberg (DE); KG, BAMBERG, Bamberg (DE)

( * ) Notice: Subject to any disclaimer, the term of this patent is extended or adjusted under 35 U.S.C. 154(b) by 212 days.

(21) Appl. No.: 16/314,121

(22) PCT Filed: Jun. 28, 2017

(86) PCT No.: PCT/EP2017/066028
§ 371 (c)(1),
(2) Date: Dec. 28, 2018

(87) PCT Pub. No.: WO2018/002157
PCT Pub. Date: Jan. 4, 2018

(65) Prior Publication Data

US 2019/0203517 A1 Jul. 4, 2019

(30) Foreign Application Priority Data

Jun. 29, 2016 (DE) ..... 102016211777.7

(51) Int. Cl.
*E05F 15/627* (2015.01)
*E05F 15/41* (2015.01)
(Continued)

(52) U.S. Cl.
CPC ..... *E05F 15/627* (2015.01); *E05F 15/41* (2015.01); *E05F 15/611* (2015.01); *E05F 15/75* (2015.01);
(Continued)

(58) Field of Classification Search
None
See application file for complete search history.

(56) References Cited

U.S. PATENT DOCUMENTS 4,979,603 A * 12/1990 Wheatland ..... A01B 61/00 192/150
5,610,484 A * 3/1997 Georgin ..... H02H 7/0851 318/286
(Continued)

FOREIGN PATENT DOCUMENTS

CN 1206444 A 1/1999
CN 101596851 A 12/2009
(Continued)

OTHER PUBLICATIONS

Wang, Jiamei et al., "Fundamentals of Testing Technology", Xidian University Press, Jan. 2015, p. 115-116.
(Continued)

*Primary Examiner* — Catherine A Kelly
(74) *Attorney, Agent, or Firm* — Brooks Kushman, P.C.

(57) ABSTRACT

A vehicle door assembly may include a vehicle door pivotally arranged on a vehicle body, a drive motor for electromotively adjusting the vehicle door, a transmission element for producing a flux of force between the vehicle door and the vehicle body to adjust the vehicle door relative to the vehicle body, and a control device for controlling the drive motor. The control device may be configured to provide an
(Continued)

anti-pinch protection. An acceleration sensor may be arranged on the vehicle door for measuring the acceleration of the vehicle door.

16 Claims, 4 Drawing Sheets

(51) Int. Cl.
*E05F 15/611* (2015.01)
*E05F 15/75* (2015.01)

(52) U.S. Cl.
CPC ... *E05Y 2201/216* (2013.01); *E05Y 2201/654* (2013.01); *E05Y 2400/44* (2013.01); *E05Y 2400/452* (2013.01); *E05Y 2800/11* (2013.01); *E05Y 2800/113* (2013.01); *E05Y 2900/531* (2013.01)

(56) References Cited

U.S. PATENT DOCUMENTS 5,982,126 A * 11/1999 Hellinga ..... B60J 5/06 318/286
6,145,917 A * 11/2000 Ishii ..... E05F 1/1091 296/146.1
6,600,285 B2 * 7/2003 Mintgen ..... B62D 25/12 318/286
6,877,791 B2 * 4/2005 Greuel ..... E05F 15/622 296/146.1
8,508,159 B2 * 8/2013 Herrmann ..... E05F 15/611 318/257
9,777,528 B2 * 10/2017 Elie ..... E05F 15/46
9,868,340 B2 * 1/2018 Nishikibe ..... E05F 1/002
10,017,975 B2 * 7/2018 Broadhead ..... E05F 15/73
10,017,976 B2 * 7/2018 Herrmann ..... E05F 15/40
10,132,112 B2 * 11/2018 Yu ..... E05F 15/76
10,538,951 B2 * 1/2020 Herrmann ..... E05F 15/70
10,570,656 B2 * 2/2020 Elie ..... E05F 15/40
10,626,659 B2 * 4/2020 Herrmann ..... E05F 15/616
2005/0217075 A1 * 10/2005 Enomoto ..... E05F 15/63 16/285
2006/0151231 A1 * 7/2006 Bucksch ..... E05F 15/63 180/337
2009/0107050 A1 4/2009 Suzuki
2014/0303852 A1 * 10/2014 Seki ..... E05F 15/40 701/49
2019/0128041 A1 * 5/2019 Haberberger ..... E05F 15/622
2019/0203517 A1 * 7/2019 Herrmann ..... E05F 15/41

FOREIGN PATENT DOCUMENTS

CN 102465645 A 5/2012
CN 103782467 A 5/2014
CN 104136701 A 11/2014
CN 104981581 A 10/2015
DE 102008064570 A1 6/2010
DE 102009000021 A1 7/2010
WO 02084061 A1 10/2002

OTHER PUBLICATIONS

Li Wei, "Fault Diagnosis Manual for Benz/BMW," Liaoning Science and Technology Publishing House, May 2010, p. 472-473.

* cited by examiner

VEHICLE DOOR ASSEMBLY HAVING A DOOR DRIVE

CROSS-REFERENCE TO RELATED APPLICATIONS

This application is the U.S. National Phase of PCT Application No. PCT/EP2017/066028 filed on Jun. 28, 2017, which claims priority to German Patent Application No. DE 10 2016 211 777.7 filed on Jun. 29, 2016, the disclosures of which are incorporated in their entirety by reference herein.

TECHNICAL FIELD

The present disclosure relates to a vehicle door assembly.

BACKGROUND

Vehicles may include a vehicle door assembly that may include a vehicle door pivotally arranged on a vehicle body, a drive motor for electromotively adjusting the vehicle door, a transmission element for producing a flux of force between the vehicle door and the vehicle body in order to adjust the vehicle door relative to the vehicle body, and a control device for controlling the drive motor.

Such a vehicle door may be configured for example as a vehicle side door or also as a liftgate. In this connection, vehicle door is understood to be any flap of a vehicle which in the closed position closes a vehicle opening.

The drive motor the vehicle door may be electromotively adjusted between a closed position and an open position. The adjustment of the vehicle door thus is affected automatically, in a way controlled by the control device.

In particular on closing of the vehicle door it must possibly be recognized when an object is disposed in the region of the closing path of the vehicle door and thus might be pinched on closing of the vehicle door. For this purpose, the control device is configured to provide an anti-pinch protection by which a pinching case is recognized and, upon recognition of a pinching case, a counter-measure is initiated, for example a reversal of the movement of the vehicle door.

SUMMARY

The present disclosure may provide one or more proposed solutions to provide a vehicle door assembly which in a simple way may provide a reliable anti-pinch protection for electromotively adjusting the vehicle door.

Accordingly, the vehicle door assembly may include a sensor device in the form of an acceleration sensor arranged on the vehicle door for measuring the acceleration of the vehicle door, or a gyrosensor arranged on the vehicle door for measuring the angular velocity of the vehicle door, or a force sensor arranged in the flux of force between the vehicle door and the vehicle body, and the control device may be configured to evaluate a sensor signal of the sensor device for the recognition of a pinching case.

According to one or more embodiments, a sensor device, which may issue a sensor signal that may indicate a movement of the vehicle door or a change in this movement with comparatively little delay and thus more directly than in the case of an indirect anti-pinch protection. Thus, such a sensor device may be used for an anti-pinch protection in that the sensor signal is evaluated in order to infer a change in the movement of the vehicle door during a moving operation with reference to the sensor signal, and with reference to this change in the movement conclude as to whether an object is present in the path of movement of the vehicle door and possibly a pinching case is imminent.

The sensor signal of the sensor device may influence the control of the vehicle door. The sensor signal may be evaluated by the control device to, for example, initiate a moving operation, for example when a user manually acts on the vehicle door in order to move the same.

In a first embodiment the sensor device is configured as an acceleration sensor for measuring the acceleration of the vehicle door. Such an acceleration sensor for example may be constructed as a piezoelectric sensor or as a so-called MEMS sensor (MEMS: Microelectromechanical System). Such an acceleration sensor may measure accelerations in a two-dimensional plane or also in the three-dimensional space.

In a second embodiment, the sensor device may be configured as a so-called gyrosensor. Such a gyrosensor, also referred to as gyrometer, measures a rotary movement, i.e. in the case of a vehicle door the swivel movement about the swivel axis about which the vehicle door is pivotable relative to the vehicle body.

In a third embodiment, the sensor device also may be formed by a force sensor arranged in the flux of force between the vehicle door and the vehicle body. The force sensor here is disposed in the flux of force before the drive motor so that the sensor signal of the force sensor may indicate a change in the adjusting movement of the vehicle door with little time delay.

The sensor signal of the sensor device may be used solely to provide an anti-pinch protection. With reference to the sensor signal that is provided by the sensor device a pinching case solely may be inferred in that with reference to a change in the movement of the vehicle door or with reference to a force signal it may be inferred whether a pinching case exists (with a high probability).

It is, however, also conceivable and possible that the control device additionally is configured to evaluate the speed of a motor shaft driven by the drive motor or the motor current of the drive motor for an indirect recognition of a pinching case. The control device thus takes account of the sensor signal of the sensor device in addition to monitoring a motor parameter in connection with an indirect anti-pinch protection so that different signals are combined with each other to recognize a pinching case. This may enable a particularly reliable anti-pinch protection.

When the sensor device is configured as an acceleration sensor or as a gyrosensor, this sensor device in the form of the acceleration sensor or the gyrosensor may be arranged for example on a door module of the vehicle door or be integrated into the control device stationarily arranged on the vehicle door. In the first case, the sensor device may be configured for example as a separate component and be arranged on an assembly carrier of the door module. In the second case, the sensor device for example is integrated into the control device and thus is arranged for example in the same housing as a circuit board of the control device, possibly even on the circuit board of the control device. The control device may likewise be arranged on an assembly carrier of the door module. In both cases, the sensor device in the form of the acceleration sensor or the gyrosensor is stationarily arranged on the vehicle door and thus is moved together with the same during a movement of the vehicle door. With reference to a sensor signal of the sensor device indicating the acceleration of the vehicle door or the swivel movement of the vehicle door the movement of the vehicle door thus may be inferred directly, wherein from a change in the movement a pinching case possibly may be inferred. When the vehicle door on closing for example abuts against an object in the closing path of the vehicle door, the movement of the vehicle door thereby is slowed down, which may be recognized by the sensor signal.

In a concrete embodiment the vehicle door assembly may include an electrically actuatable coupling device which in a coupling, first condition couples the drive motor to the transmission element in order to exert an adjusting force for adjusting the vehicle door on the transmission element. In a decoupling, second condition the coupling device on the other hand decouples the drive motor from the transmission element so that the vehicle door for example may be manually adjusted independent of an actuation of the drive motor. Via the coupling device, the flux of force between the vehicle door and the vehicle body thus may be eliminated so that an adjustment of the vehicle door independent of an actuation of the drive motor, for example manually by a user, is possible.

In one or more embodiments, the drive motor may be stationarily arranged on the vehicle door. In this case, the transmission element may be formed for example as a so-called catch strap and be articulated to the vehicle body. For adjusting the vehicle door, the drive motor acts on the transmission element and adjusts the same so that via the transmission element a relative movement between the vehicle door and the vehicle body may be affected.

In principle, different embodiments for coupling the drive motor to the transmission element are conceivable and possible. For example, the drive motor may engage into a toothing of the transmission element via a pinion in order to adjust the transmission element by rotating the pinion. When the drive motor is stationarily arranged on the vehicle door and the transmission element is articulated to the vehicle body, the vehicle door is pivoted relative to the vehicle body by adjusting the transmission element relative to the drive motor.

In another embodiment, the drive motor may be coupled to the transmission element for example via a cable drive. For this purpose, a drive shaft drivable by the drive motor may be coupled to the transmission element via a flexible coupling element formed for the transmission of tensile forces—such as a traction cable, a ribbon, a strap or a belt. The coupling element for example may be attached to the transmission element with two ends and be placed around a roller element arranged on the drive shaft, for example around a cable drum, so that by rotating the roller element the coupling element rolls off on the roller element and the transmission element thereby is adjusted relative to the drive motor.

In this case, a sensor device in the form of a force sensor may be arranged for example on the transmission element and serve for measuring a force on the coupling element. For example, a sensor device in the form of a force sensor may be arranged on a tensioning device for tensioning the coupling element relative to the transmission element. Via the tensioning device an end of the coupling element may be fixed to the transmission element, wherein the tensile stress in the coupling element may be set via the tensioning device. When a pinched object impedes the adjusting movement, the adjusting movement of the vehicle door changes the force acting on the coupling element, which may be recognized via the force sensor and be utilized to recognize a pinching case.

In another embodiment, a sensor device in the form of a force sensor also may be configured to measure a torsion of the drive shaft. Such a sensor device may be for example, a contactless, inductive sensor or capacitive sensor that may measure the position of an eccentric disk on the drive shaft. When it is detected via the sensor that a torsion occurs on the drive shaft, the force acting on the drive shaft in the flux of force may be inferred therefrom.

BRIEF DESCRIPTION OF THE DRAWINGS

The embodiments will be explained in detail below with reference to the exemplary embodiments illustrated in the Figures.

DETAILED DESCRIPTION

Different concepts to provide an anti-pinch protection are known.

In connection with an indirect anti-pinch protection it is possible for example to monitor the speed of the motor shaft of the drive motor or the motor current of the drive motor. When the speed of the drive motor falls below a threshold value or when the motor current is increased above a threshold value, it may be concluded therefrom that an object is present in the closing path of the vehicle door and impedes the movement of the vehicle door (so-called pinching case). By monitoring motor parameters and thus indirectly, i.e. not directly on the vehicle door to be adjusted the indirect anti-pinch protection a recognition of a pinching case thus is affected.

In a direct anti-pinch protection on the other hand the recognition of a pinching case is affected directly on the adjustment part to be adjusted, in this case on the vehicle door, in that sensors, for example tactile sensors (e.g. capacitive sensors) are provided on the vehicle door.

An indirect anti-pinch protection has a variety of uses, for example in window lifter drives. For a reliable recognition of a pinching case, an indirect anti-pinch protection however requires that a change in the movement of the adjustment part also influences the monitored parameters, for example the speed of the drive motor or the motor current, without a significant time delay. This is ensured in a rigid adjustment system. In a vehicle door, however, the adjustment mechanism may have a comparatively large elasticity so that the adjustment system of a vehicle door possibly is comparatively soft and thus a change in the movement of the vehicle door influences the speed of the drive motor or the motor current only with a time delay. Hence it possibly follows that on pinching of an object at a vehicle door comparatively large forces may occur already, before a pinching case may be inferred with reference to the speed or the motor current.

A direct anti-pinch protection on the other hand requires that all surfaces and edges at which a pinching case might occur are monitored by suitable sensors. In a usually large-surface vehicle door this may be difficult.

Figure 1:
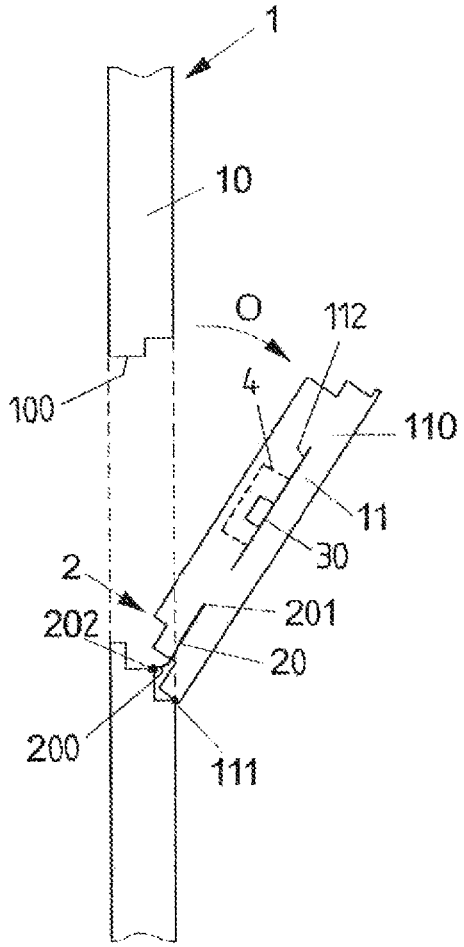
FIG. 1 shows a schematic view of an adjustment element in the form of a vehicle door on a stationary portion in the form of a vehicle body.

FIG. 1 shows a schematic view of a vehicle 1 that includes a vehicle body 10 and an adjustment element in the form of a vehicle door 11, which is arranged on the vehicle body 10 via a joint pivotable via a joint 111 and is pivotable about a swivel axis along an opening direction O.

The vehicle door 11 may be realized for example by a vehicle side door or also by a liftgate. In a closed position the vehicle door 11 covers a vehicle opening 100 in the vehicle body 10, for example a side door opening or a liftgate opening.

A driving device 2 arranged in a door interior space 110 the vehicle door 11 may electromotively move the door from its closed position into an open position, so that the vehicle door 11 may be moved automatically in an electromotive way. The adjusting device 2, schematically illustrated in FIG. 2 and in an exemplary embodiment shown in FIGS. 3 to 5, includes a drive motor 22 which via a coupling device 21 is coupled to a transmission element 20, to transmit adjusting forces between the vehicle door 11 and the vehicle body 10. In this exemplary embodiment, the drive motor 22 may be stationarily arranged on the vehicle door 11, while the transmission element 20 in the manner of a so-called catch strap is articulated to an end 200 and thus pivotally fixed to the vehicle body 10.

In the exemplary embodiments of the driving device 2 as shown in FIGS. 2 and 3 to 5 the drive motor 22 serves for driving a drive element 23 in the form of a cable drum, which via a coupling element 24 in the form of a flexible, slack pulling element, in particular in the form of a pull cable (for example a steel cable) formed to transmit (exclusively) tensile forces, is coupled to the transmission element 20. The cable drum 23, for example, may be supported on the longitudinally extending transmission element 20 and roll off on the transmission element 20.

The coupling element 24 is connected to the transmission element 20 via a first end 240 in the region of the end 200 of the transmission element 20 and via a second end 241 in the region of a second end 201 and slung around the drive element 23 in the form of the cable drum. When the drive element 23, driven by the drive motor 22, is put into a rotary movement, the coupling element 24 in the form of the pulling element (pull cable) rolls off on the drive element 23, so that the drive element 23 is moved relative to the transmission element 20 and thus along the longitudinal direction of the transmission element 20 relative to the transmission element 20, which leads to an adjustment of the vehicle door 11 relative to the vehicle body 10.

It should be noted at this point that other construction forms of driving devices also are conceivable and possible. For example, the drive motor 22 also may drive a pinion that is in meshing engagement with the transmission element 20. It is also conceivable and possible that the driving device is formed as a spindle drive for example with a rotatable spindle that is in engagement with a spindle nut.

The coupling device 21 serves to couple the drive motor 22 to the drive element 23 or to decouple the same from the drive element 23. In a coupling condition the coupling device 21 produces a flux of force between the drive motor 22 and the drive element 23, so that a rotary movement of a motor shaft 220 of the drive motor 20 is transmitted to the drive element 23 and accordingly the drive element 23 is put into a rotary movement, in order to thereby introduce an adjusting force into the transmission element 20. In a decoupling condition, on the other hand, the drive motor 22 is decoupled from the drive element 23, so that the drive motor 22 may be moved independent of the drive element 23 and inversely the drive element 23 may be moved independent of the drive motor 22. In this decoupling condition for example a manual adjustment of the vehicle door 11 may be possible without the drive motor 22 being loaded with forces.

The coupling device 21 also may have a third coupling condition, corresponding to a slipping condition in which coupling elements slipplingly are in contact with each other. A first coupling element here is operatively connected to a motor shaft of the drive motor 22, while a second coupling element is operatively connected to the drive element 23. In this slipping, third condition the coupling device 21 for example may provide a braking force during a manual adjustment of the vehicle door 11, caused by the slipping contact of the coupling elements with each other.

Figure 3:
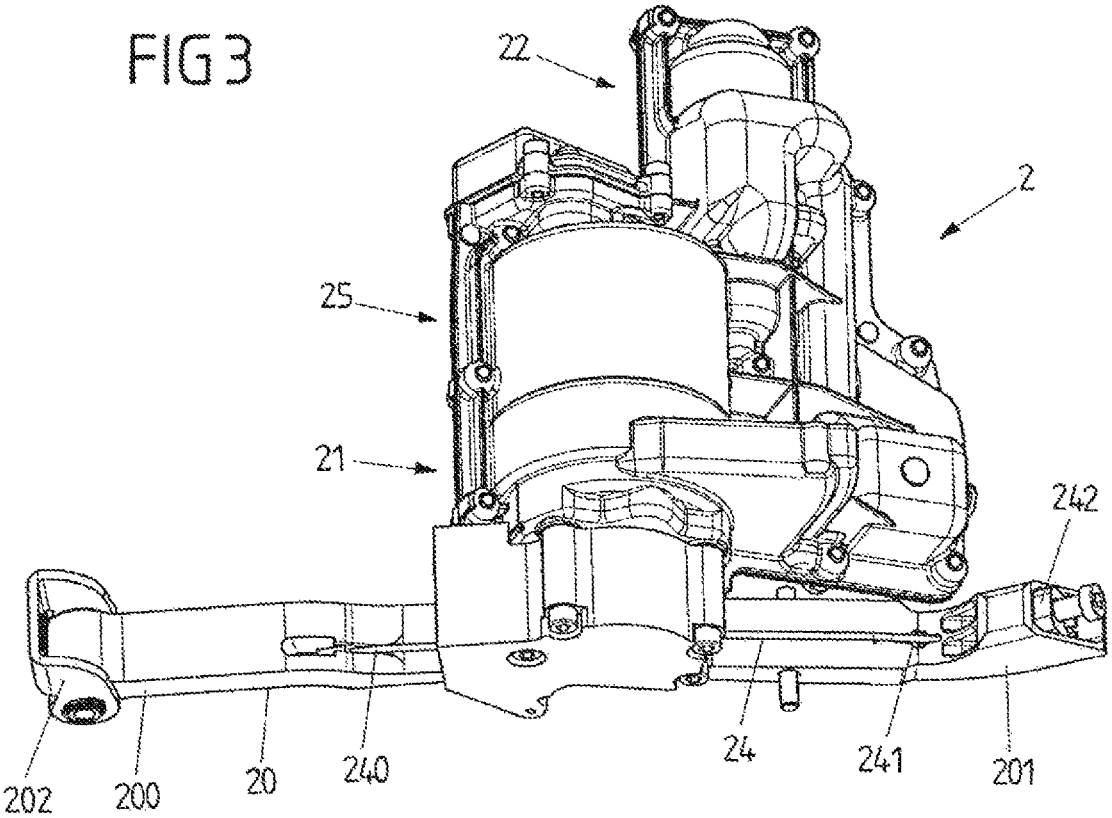
FIG. 3 shows a view of an exemplary embodiment of a door drive for adjusting a vehicle door.
Figure 4:
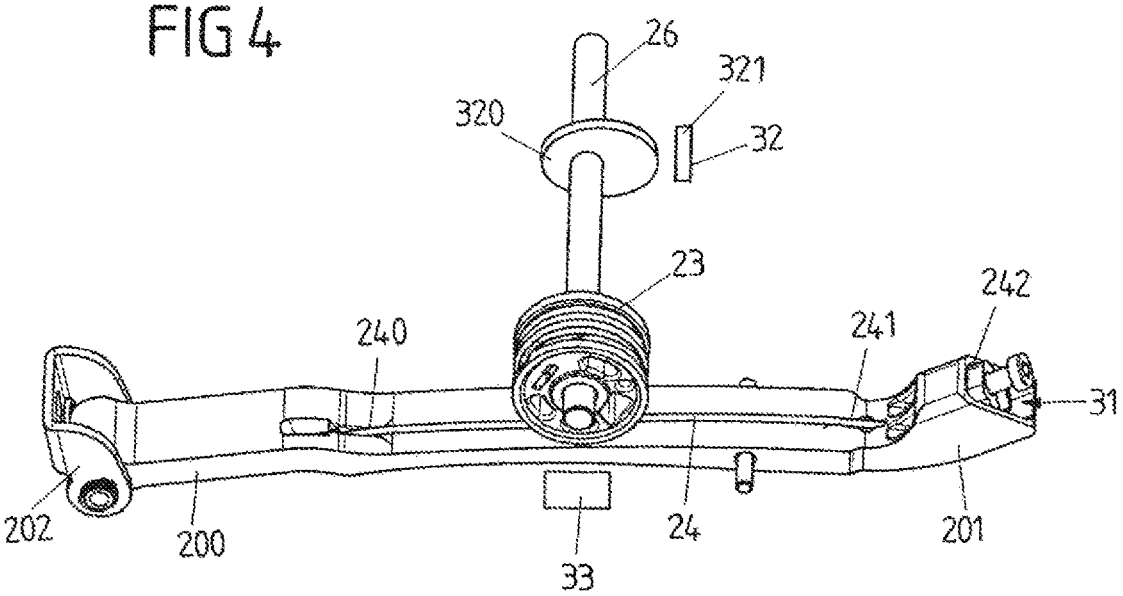
FIG. 4 shows a view of a sub-assembly of the door drive.
Figure 5:
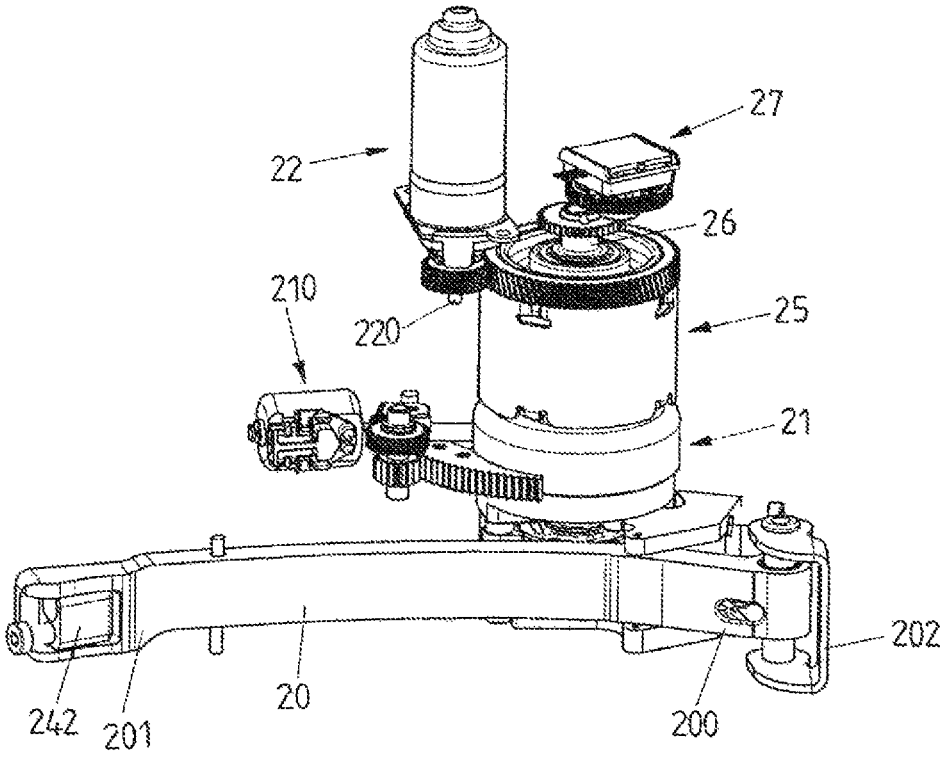
FIG. 5 shows a view of a drive motor, a transmission and a coupling device of the door drive.

In the exemplary embodiment concretely shown in FIGS. 3 to 5 the drive motor 22 includes a motor shaft 220 which in operation of the door drive 2 is put into a rotary movement and is operatively connected to a transmission 25 (for example a planetary transmission). Via the transmission 25 a drive shaft 26 is driven, on which the drive element 23 in the form of the cable drum is non-rotatably arranged so that by rotating the drive shaft 26 the drive element 23 may be driven, the coupling element 24 in the form of the traction cable thereby rolls off on the drive element 23 and the transmission element 20 thus is adjusted for moving the vehicle door 11. Via a sensor device 27 the absolute position of the drive shaft 26 in operation may be determined.

In its coupling condition, the coupling device 21 electrically actuatable via an actuating drive 210 produces a flux of force between the transmission 25 and the drive shaft 26 so that in the coupling condition of the coupling device 21 an adjusting force may be transmitted from the drive motor 22 to the drive shaft 26 and thereby onto the transmission element 20. In its decoupling condition, the coupling device 21 on the other hand eliminates a flux of force between the drive motor 22 and the drive shaft 26 so that the transmission element 20 may be adjusted relative to the drive motor 22 without a force being applied onto the drive motor 22.

The coupling element 24 in the form of the traction cable is firmly connected to the transmission element 20 via a first end 240 in the region of the end 200 of the transmission element 20. A second end 241 of the coupling element 24 on the other hand is connected to the end 201 of the transmission element 20 via a tensioning device 242. Via the tensioning device 242, the tension of the coupling element 24 may be set at the transmission element 20.

Figure 2:
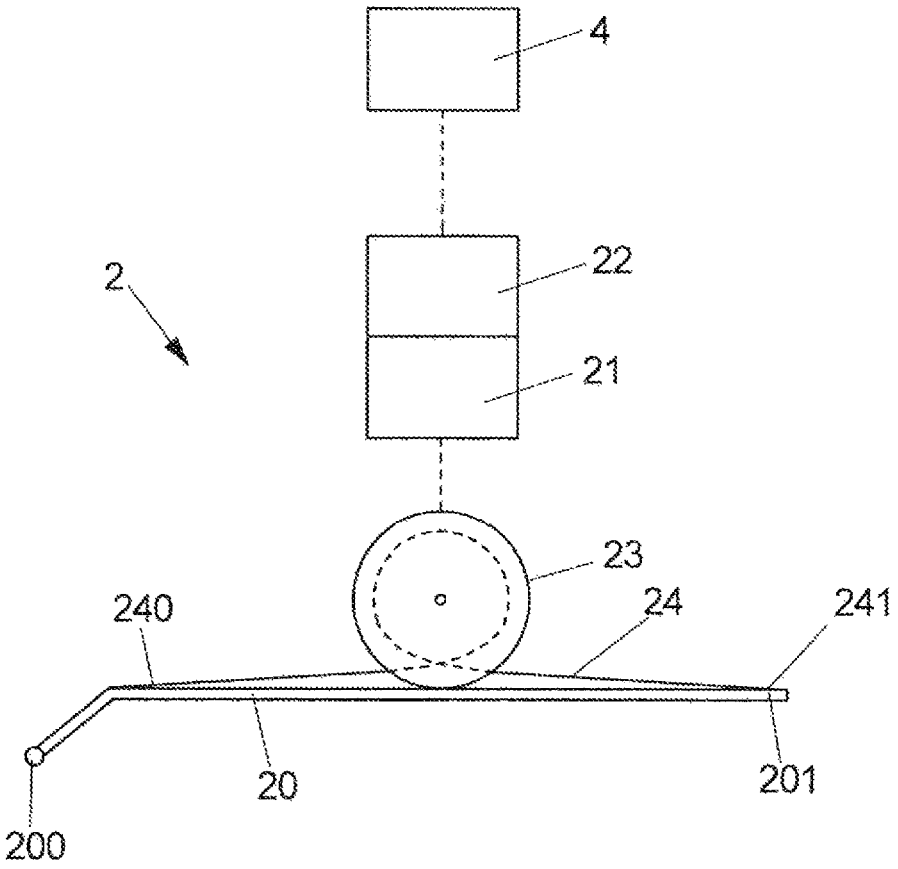
FIG. 2 shows a schematic view of a door drive with a drive motor, a coupling device, a control device and a transmission element for the force transmission for adjusting the vehicle door.

As schematically shown in FIG. 2, the operation of the drive motor 22 is controlled via a control device 4, which for example, as indicated in FIG. 1, may be arranged on an assembly carrier of a door module 112 of the vehicle door 11. Such an assembly carrier for example may carry different functional components of the vehicle door 11, for example a window lifter device, a loudspeaker, a door lock or the like. In this connection, the control device 4 may serve for controlling the door drive 2, but in addition also for controlling other functional components of the vehicle door 11.

When moving the vehicle door 11, the control device 4 must recognize whether objects are arranged in the path of movement of the vehicle door 11, i.e. in the space swept over by the vehicle door 11 during its movement, in order to avoid in particular an excessive action of force on such objects depending on such recognition. For this purpose, the control device 4 is designed to provide an anti-pinch protection that serves to recognize the pinching of an object between the vehicle door 11 and the vehicle body 10 at an early stage on closing of the vehicle door 11 so that such pinching cannot lead to a damage of the object (in particular not to an injury of a person) and neither to damages of the adjustment system.

In connection with the anti-pinch protection it shall be recognized in particular whether during the movement of the vehicle door 11 changes in the adjusting movement are obtained, which are not caused by the drive motor 22. When it is detected, for example, that the vehicle door 11 is braked via the drive motor 22 despite an introduction of force, this may indicate the pinching of an object between the vehicle door 11 and the vehicle body 10, whereupon the control device 4 may initiate suitable counter-measures, for example stopping of the adjusting movement or reversing of the vehicle door 11, i.e. a renewed opening of the vehicle door 11 by a certain distance.

Usually, such an anti-pinch protection may be affected by indirectly monitoring motor parameters, e.g. the motor current or the motor speed. When it is detected that the speed of the motor shaft 220 of the drive motor 22 is reduced below a threshold value, this may indicate a pinching case, which may be evaluated correspondingly and be used to initiate suitable counter-measures. Alternatively, or in addition, the motor current may be monitored. In general, the motor current rises with the force provided by the drive motor 22 so that with reference to a rise in the motor current a force increases on the vehicle door 11 may be inferred. When the motor current rises above a threshold value, a pinching case may be inferred therefrom so that suitable counter-measures may be initiated.

In general, it is to be assumed that the mechanism of the adjustment system of the vehicle door 11, as it is shown for example in FIGS. 3 to 5, is comparatively elastic. A force may increase on the vehicle door 11 for example, as a result of a pinching case thus will lead to a reduction of the speed at the drive motor 22 or to a rise in the motor current merely with a time delay.

To thus provide for recognition of a pinching case with less time delay, a sensor device 30 in the form of an acceleration sensor or a gyrosensor for example may be arranged on the vehicle door 11, as this is schematically shown in FIG. 1. Via such a sensor device 30, the movement of the vehicle door 11 and in particular a change in the movement of the vehicle door 11 may be inferred directly and with little time delay in order to therefrom draw conclusions as to a possible pinching case.

The acceleration sensor may measure the acceleration of the vehicle door 11. When the vehicle door 11 is braked out of its movement, this leads to an acceleration signal on the sensor device 30 configured as an acceleration sensor. When the amount of the (negative) acceleration is greater than a threshold value, it may be inferred that a pinching case exists so that suitable counter-measures may be initiated.

A sensor device 30 configured as a gyrosensor on the other hand measures the angular velocity, i.e. the swivel movement of the vehicle door 11. From the angular velocity and in particular from the change in the angular velocity braking of the vehicle door 11 may be recognized, so as to recognize a pinching case and possibly initiate suitable counter-measures.

The sensor device 30 in the form of the acceleration sensor or the gyrosensor is stationarily arranged for example on an assembly carrier of a door module 112. The sensor device 30 may be configured as a separate assembly and be arranged on the assembly carrier. It is also conceivable and possible, however, to integrate the sensor device 30 into the control device 4.

In an alternative embodiment there may also be provided a sensor device 31-33 that generates a sensor signal from which a force in the flux of force between the vehicle door 11 and the vehicle body 10 may be inferred (in this text, such a sensor device shall be referred to as "force sensor").

In a first variant, as is schematically shown in FIG. 4, such a sensor device 31 in the form of a force sensor may be arranged for example on the tensioning device 242 in order to measure a force applied to the coupling element 24. When it is recognized that the force on the coupling element 24 rises, possible pinching of an object between the vehicle door 11 and the vehicle body 10 may be inferred therefrom.

In a second variant, a sensor device 32 may recognize and measure a torsion of the drive shaft 26. For this purpose, an inductive or capacitive sensor module 321 for example may determine the distance to an eccentric disk 320. When the rotational speed of the eccentric disk 30 deviates from the rotational speed of the motor 22 during an adjustment, this may indicate a braking force applied to the vehicle door 11, which causes a torsion of the drive shaft 26.

Therefrom, a force may be inferred, and therefrom possibly a pinching case.

Analogously, in a third variant a sensor device 33 may also be arranged in the region of the drive element 23 in the form of the cable drum in order to infer a torsion of the drive shaft 23 with reference to a rotation of the drive element 23 or an element arranged on the drive shaft 26 in the region of the drive element 23.

Due to the fact that such a sensor device 31-33 is arranged in the flux of force before the drive motor 32, the sensor device 31-33 generates a sensor signal that may indicate a pinching case with less time delay. By evaluating such a sensor signal that indicates the force in the flux of force at a place before the drive motor 42, a pinching case may thus be inferred.

The sensor devices 31-33 may each be used separately. It is also conceivable and possible, however, to use the sensor devices 31-33 in combination with each other.

Sensor signals of the sensor device 30-33 may be evaluated alone in order to infer a pinching case from these sensor signals. It is also conceivable and possible, however, to combine an indirect recognition with reference to the speed of the drive motor 22 or the motor current with an evaluation of sensor signals of the sensor device 30-33 in connection with an anti-pinch protection in order to provide for a particularly reliable recognition of a pinching case.

The idea underlying the embodiments is not limited to the exemplary embodiments described above, but may also be realized in principle in a completely different way.

A door drive in particular may also include a different adjusting mechanism, for example in that the drive motor cooperates with a transmission element by engagement of a pinion. Alternatively, however, the door drive may also be configured e.g. as a spindle drive in which e.g. a spindle is rotated and is in engagement with a spindle nut, so that the spindle nut is shifted along the spindle due to the rotary movement of the spindle.

LIST OF REFERENCE NUMERALS

1 vehicle
10 stationary portion (vehicle body)
100 vehicle opening
11 vehicle door
110 door interior space
111 door joint
112 door module

2 driving device
20 transmission element (catch strap)
200, 201 end
202 joint
21 coupling device
210 actuating drive
22 drive motor
220 motor shaft
23 drive element
24 coupling element (pull cable)
240, 241 end
242 tensioning device
25 transmission
26 shaft
27 sensor device
28 door module
30-33 sensor device
320 eccentric disk
321 sensor module
4 control device
O opening direction

The invention claimed is:

1. A vehicle door assembly, comprising
a vehicle door pivotally arranged on a vehicle body;
a drive motor for electromotively adjusting the vehicle door;
a transmission element for producing a flux of force between the vehicle door and the vehicle body in order to adjust the vehicle door relative to the vehicle body;
a drive shaft configured to be driven by the drive motor;
an eccentric disc arranged on the drive shaft;
a sensor device including a contactless sensor arranged in the flux of force between the vehicle door and the vehicle body and configured to measure a position of the eccentric disc indicative of a torsion applied to the drive shaft; and
a control device configured to, responsive to receiving a sensor signal, based on the torsion applied to the drive shaft, from the contactless sensor device, recognize a pinching case.

2. The vehicle door assembly of claim 1, wherein the control device is configured to, responsive to receiving a speed of a motor shaft driven by the drive motor or a motor current of the drive motor, provide indirect recognition of a pinching case.

3. The vehicle door assembly of claim 1, wherein the sensor device includes an acceleration sensor or a gyrosensor each arranged on a door module of the vehicle door or integrated into the control device stationarily arranged on the vehicle door.

4. The vehicle door assembly of claim 1, further comprising an electrically actuatable coupling device which in a coupling, a first condition couples the drive motor to the transmission element in order to exert an adjusting force for adjusting the vehicle door on the transmission element, and in a decoupling, a second condition decouples the drive motor from the transmission element.

5. The vehicle door assembly of claim 1, wherein the drive motor is stationarily arranged on the vehicle door and the transmission element is configured to articulate with respect to the vehicle body.

6. The vehicle door assembly of claim 1, wherein the drive shaft is coupled to the transmission element via a flexible coupling element configured for the transmission of tensile forces.

7. The vehicle door assembly of claim 6, wherein the sensor device includes a force sensor arranged on the transmission element and configured to measure a force on the coupling element.

8. The vehicle door assembly of claim 7, wherein the sensor device includes a force sensor is-arranged on a tensioning device configured to tension the coupling element relative to the transmission element.

9. A vehicle door assembly, comprising:
a vehicle door pivotally arranged on a vehicle body;
a drive motor configured to electromotively adjust the vehicle door;
a drive shaft configured to be driven by the drive motor;
an eccentric arranged on the drive shaft a sensor configured to measure rotational speed of the eccentric;
a catch strap disposed between the vehicle body and the vehicle door, operatively connected to the drive motor, and configured to transmit forces to adjust the vehicle door;
a gyrosensor sensor arranged in the vehicle door configured to measure an angular velocity of the vehicle door; and
a control device configured to provide an anti-pinch protection action, in response to, a difference between angular velocity values received from the gyrosensor and indicative of the angular velocity of the vehicle door and rotational speed values received from the sensor.

10. The vehicle door assembly of claim 9, wherein the vehicle door includes a door module configured to carry a window lifter, or a door lock, or both, and wherein the gyrosensor is attached to the door module.

11. The vehicle door assembly of claim 9, wherein the gyrosensor is integrated into the control device.

12. The vehicle door assembly of claim 9, wherein the sensor is a capacitive sensor.

13. The vehicle door assembly of claim 9, wherein the sensor is an inductive sensor.

14. The vehicle door assembly of claim 9, wherein the control device is further configured to provide the anti-pinch protection in response to motor-shaft speed values, received from the drive motor, exceeding a predetermined motor-shaft speed threshold.

15. A vehicle door assembly, comprising:
a vehicle door pivotally arranged on a vehicle body;
a drive motor configured to electromotively adjust the vehicle door;
a drive shaft configured to be driven by the drive motor;
a cable drum disposed on the drive shaft a catch strap disposed between the vehicle body and the vehicle door and operatively connecting the drive shaft to the drive motor and configured to transmit forces to adjust the vehicle door;
a force sensor coupled to the catch strap configured to measure a force applied to the vehicle door by the catch strap;
a sensor configured to measure a rotational speed of the cable drum; and
a control device configured to, compare force values, received from the force sensor and indicative of the force applied to the vehicle door, and rotational speed values, received from the sensor, provide an anti-pinch protection action.

16. The vehicle door assembly of claim 15, wherein the catch strap includes a first end configured to be coupled to the vehicle body and a second end configured to be coupled to the vehicle door, wherein the force sensor is disposed on the second end of the catch strap.

* * * * *